US005697449A

United States Patent [19]

Hennig et al.

[11] Patent Number: 5,697,449

[45] Date of Patent: Dec. 16, 1997

[54] APPARATUS AND METHOD FOR TEMPORARY SUBSURFACE WELL SEALING AND EQUIPMENT ANCHORING

[75] Inventors: Gregory E. Hennig; David Martin; Mark McCorry, all of Aberdeen, Scotland

[73] Assignee: Baker Hughes Incorporated, Houston, Tex.

[21] Appl. No.: 562,040

[22] Filed: Nov. 22, 1995

[51] Int. Cl.[6] ..... E21B 23/06; E21B 34/12

[52] U.S. Cl. ..... 166/382; 166/124; 166/129; 166/133; 166/330; 166/332.2; 166/386

[58] Field of Search ..... 166/387, 386, 166/129, 133, 183, 188, 332.7, 332.2, 332.4, 334.2, 124, 382, 330

[56] References Cited

U.S. PATENT DOCUMENTS

| | | | |
|---|---|---|---|
| 2,384,192 | 9/1945 | Otis et al. | 166/129 X |
| 3,171,491 | 3/1965 | States | 166/124 |
| 3,232,347 | 2/1966 | Thrane | 166/124 X |
| 3,306,366 | 2/1967 | Muse | 166/334.1 |
| 3,465,820 | 9/1969 | Kisling, III | 166/124 X |
| 3,543,849 | 12/1970 | Kilgore | 166/128 |
| 4,598,774 | 7/1986 | Nevels et al. | 166/382 |

FOREIGN PATENT DOCUMENTS 868647 5/1961 United Kingdom .

OTHER PUBLICATIONS

Baker Oil Tools, Remedial and Stimulation, 1994, pp. 13, 18 and 19.

*Primary Examiner*—Hoang C. Dang
*Attorney, Agent, or Firm*—Browning Bushman

[57] ABSTRACT

A retrievable packoff assembly for temporarily sealing a well pipe and anchoring equipment at a subsurface location within the pipe. The assembly is connected to a tubular actuation tool which is manipulated from the surface to position the assembly at a subsurface well location, set the assembly and then release from the set assembly. Right-hand tool rotation sets the assembly, releases the tool, and is subsequently employed to reengage and unset the assembly for retrieval to the surface. A bypass flow passage in the assembly is controlled by a sliding sleeve valve which is automatically closed by the right-hand tool rotation during setting and release and automatically reopened by tool rotation occurring during retrieval of the assembly. Flow through both the assembly and the bypass is confined within the actuation tool. A control flow passage in the apparatus is sealed by a retrievable blanking plug which may be removed to permit passage of equipment through the anchored assembly. The sealed assembly holds pressure from above or below. Drill pipe or other equipment may be supported in the well pipe by the set assembly.

32 Claims, 3 Drawing Sheets

APPARATUS AND METHOD FOR TEMPORARY SUBSURFACE WELL SEALING AND EQUIPMENT ANCHORING

FIELD OF THE INVENTION

The present invention relates generally to hydrocarbon recovery operations and well completion techniques. More specifically, the invention relates to a retrievable mechanical anchoring and sealing device which may be employed within a well pipe to selectively seal the pipe and to temporarily support equipment within the pipe.

DESCRIPTION OF THE PRIOR ART

There are many situations during which it is necessary to temporarily seal a well pipe at a subsurface location within the well. One common such situation occurs when a well is being drilled at an offshore location and it becomes necessary to temporarily abandon the well site, for example, when a hurricane or other dangerous condition threatens. Temporary abandonment of a well is simplified if the drill string may be left in the well rather than being racked in the derrick or broken down into individual joints and laid on a pipe rack. It is common practice in such emergency situations to temporarily suspend the drillstring from a subsurface hanger assembly which supports the drill string and seals the well. This hanger assembly is preferably positioned in the well pipe at a location below the bottom of the water body to protect the hanger and suspended string from damage which would otherwise occur if the well pipe above the water bottom is damaged or destroyed.

Where the well site is in deep water or when a floating drilling platform is being used, there is a substantial amount of surface and water induced movement of the well pipe and surface equipment, particularly when severe weather conditions are present. Positive control over the placement and setting of the subsurface well equipment which is to be used to support the drill string and seal the well can become extremely difficult. The problem is particularly severe when the subsurface equipment must be set by weight applied through a running string extending from the well surface. Typically, weight-set subsurface assemblies are activated by a combination of axial and rotational running tool movements which permit string weight to be applied to the assembly. The application of sufficient weight to the subsurface assembly causes mechanical slips and an elastomeric-packer seal to extend out to form an anchored, sealing engagement with the surrounding well pipe. Release of the actuation tool from the anchored assembly frequently requires another sequence of tool movements. Because of the surface induced movements associated with deep offshore wells and in drilling from floating vessels, weight-set subsurface tools are subject to being inadvertently set or released at undesired times and at undesired subsurface locations.

Subsurface assemblies designed to seal the well pipe can also encounter pressure differentials which restrict their movement as they are lowered or raised in the well pipe. When the assembly is being set or released, pressure differentials resulting across a sealed assembly can also adversely affect the placement or retrieval of the assembly. These pressure related problems are minimized by maintaining a flow bypass passage across the assembly which is open during movement through the well pipe and closed when the assembly is set. Opening and closing of the bypass presents a problem in some of the prior art designs where undesired surface induced movement of the setting tool can interfere with proper valve operation. Positive control over the opening and closing of the bypass is not possible with certain prior art designs so that the open or closed status of the valve when the assembly is set will not be known. The problem is repeated when a set, sealed assembly with the bypass closed is first reengaged during the retrieval process. It is usually desireable to reopen the bypass to prevent the previously described pressure differential caused problems as the assembly is retrieved to the well surface. Again, the presence of undesired surface induced movement in the retrieving tool may prevent proper opening of the bypass and can also interfere with release of the assembly from its set position. It may also be necessary to repeatedly open and close the bypass during performance of downhole operations. Multiple operations are not possible in some of the prior art designs.

Another problem associated with certain prior art bypass designs is that the flow paths provided for fluid flow are too small which restricts the speed of assembly movement through the pipe. The small openings are also more subject to being plugged or otherwise restricted by sand or other particulate matter in the well fluids.

One of the limitations of certain prior art designs is the need for extensive repair or redressing following each run and retrieval of a subsurface anchoring assembly. The damage frequently occurs during landing or retrieval of the blanking plug used to seal the control assembly passage. The complex design and construction of some of these prior art assemblies make it necessary to perform repair operations in a machine shop. Even where repair is possible using replacement parts, the complexity of these prior art devices require that the repairs be made by specially trained technicians using complex tools and procedures. The number and assortment of repair parts required to be on hand at the well site can also be extensive. Time loss associated with waiting for repairs can be very expensive, particularly when the delay interferes with a remote offshore drilling operation.

The disadvantages of the prior art are overcome by the present invention, and improved equipment and techniques for well sealing and anchoring tools within a pipe are hereinafter disclosed.

BRIEF DESCRIPTION OF THE INVENTION

The assembly of the present invention is anchored and released within a well pipe with a simple, positively controlled sequence of actuation tool movements which prevents weather and water induced surface movements from inadvertently setting or releasing the assembly. Control over the actuation tool movements ensures that the assembly is positively set and that it is set at the desired subsurface location. A unique clutch arrangement connecting the assembly with the actuation tool allows the assembly to be reciprocated as often and as strenuously as desired as it is being lowered into position without being inadvertently set or released from the actuation tool. With the clutch engaged, the assembly may be repeatedly set and unset using only rotary and axial movement of the actuation tool.

Setting and retrieval of the assembly as well as the opening and closing of a bypass flow passage through the assembly are all positively initiated and controlled by selected axial forces and right-hand rotation of the actuation tool imparted from the surface. The initial right-hand tool rotation sets a packer seal and anchoring slips in the assembly. The assembly may be unset with a straight axial pull and rotation of the actuation tool and then be reset by rotation of the tool.

When it is desired to release from the set assembly, a sequence of torque and axial movements applied through the tool moves a cam pin through a slotted sleeve to disengage the clutch of the present invention so that subsequent right-hand tool rotation disengages left-hand threads which releases the assembly from the tool. As the anchoring tool is being rotated out of the assembly, a control sleeve is drawn along with the tool to close a bypass flow opening extending through the assembly and communicating with the actuation tool so that the well pipe is completely sealed when the tool is released.

When retrieving the assembly, the actuation tool is reengaged with the assembly and rotated to the right to engage right-hand threads in the assembly with right-hand threads in the tool. This motion automatically shifts the sleeve back to its open position to reestablish flow communication across the assembly. The reengaged assembly is then released by a straight axial pull on the actuation tool. Any time the bypass is open, and just before the bypass is opened or closed, the sealing elements in the sleeve are isolated from fluid flow and pressure differentials to prevent the seals from being damaged or displaced.

An important feature of the present invention in that the setting and release system employs right-hand rotation to impart significant right-hand torque as required to both set and release the assembly. The tubular actuation tool is composed of a number of joints of pipe joined by conventional right-hand threads. While this configuration permits right-hand rotation with accompanying large right-hand torque forces transmitted to the assembly, it is not desireable to rotate such a string to the left nor to attempt to impart large left-hand torque forces through the string because of the possibility of disengaging the right-hand threads holding the string together.

Accordingly, one of the important features of the present invention is the provision of a clutch mechanism which initially sets the assembly by right-hand rotation of the actuation tool and then is selectively activated from the surface with nominal control movements and torque forces to permit subsequent right-hand rotation of the tool to release the actuation tool from the set assembly. This feature permits the application of relatively large rotary torque forces through the actuation tool for both setting and releasing from the assembly.

It is also an important feature of the invention that all functions requiring significant force applications to the anchoring assembly are effected by right hand rotation and axial pulling of the actuation tool. Uncontrolled axial movements of the actuation tool caused by the floating drilling vessel or by water movement against the well pipe can neither set nor release the subsurface assembly. Moreover, with the novel design of the assembly of the present invention, the actuation tool can not be released from the anchoring assembly until after the assembly has been set to thereby prevent inadvertent separation of the assembly and tool.

Automatic and positive control of the flow passage is also achieved with the design of the present invention. The bypass flow passage in the anchor assembly is mechanically linked with the actuation tool so that it must remain open while the assembly is attached to the tool and it must be in closed position when the tool is separated from the assembly. This ensures that the valve is open during placement of the assembly and is closed when the assembly is separated from the tool. On retrieval, the tool mechanically shifts the bypass open as it reengages the anchored assembly to relieve any pressure differential across the assembly and to allow free retrieval.

All of the described operations, assembly setting, valve closing, assembly and tool separation, assembly and tool reengagement and valve opening are accomplished by right-hand rotation of the actuation tool. Release of the anchored assembly is accomplished by a straight upward pull and rotation of the attached actuation tool.

The clutch of the present invention is initially prepared for disengagement by control movements which include application of a slight left-hand torque to the tool accompanied by a slight upward pull and followed by a partial release of weight onto the anchoring assembly. It will be appreciated that while axial forces and left-hand torque are employed as control movements to prepare the clutch for disengagement, these movements occur only after the assembly has been positioned at the desired subsurface location and must occur in the specified sequence. The preliminary tool manipulation shifts a key through cam slots to permit a small axial and circumferential displacement of the actuation tool and the anchored assembly so that the subsequent application of weight to the assembly shears connecting pins in the clutch and permits the tool to be rotated to the right relative to the anchored assembly. This rotational movement causes left-hand threads securing the tool to the assembly to disengage and separate to permit retrieval of the tool to the surface.

From the foregoing it will be appreciated that a primary object of the present invention is to provide an assembly which may be positively anchored at a selected subsurface location using surface induced control and setting procedures which are independent of ship or platform movements.

Another object of the invention is to provide a fluid bypass valve in a subsurface anchoring and sealing assembly which can be positively controlled between its opened and closed valve positions.

It is an object of this invention to provide a subsurface sealing and anchoring assembly which may be repeatedly set and released by right-hand torque coupled with axial tension forces applied through a surface operated actuation tool.

Another object of the invention is to provide a subsurface assembly in which the motion used in releasing from or reengaging the set assembly automatically opens or closes a flow passage through the assembly.

It is an object of the present invention to provide a subsurface assembly which automatically isolates seals in a subsurface valve to protect the seals when the valve is open or when it is moving between open and closed positions.

One of the additional objects of the invention is to provide a subsurface anchoring and sealing assembly having a plug receiving sleeve which may be easily repaired or replaced at the well site.

A related object of the invention is to provide a subsurface assembly which is equipped with multiple openings providing large volume flow bypass to prevent blockage of the bypass and to reduce pressure induced restriction to movement of the assembly through the well.

These and further objects, features and advantages of the present invention become apparent from the following detailed description, wherein reference is made to the figures in the accompanying drawings.

DESCRIPTION OF THE PREFERRED EMBODIMENTS

Figure 1:
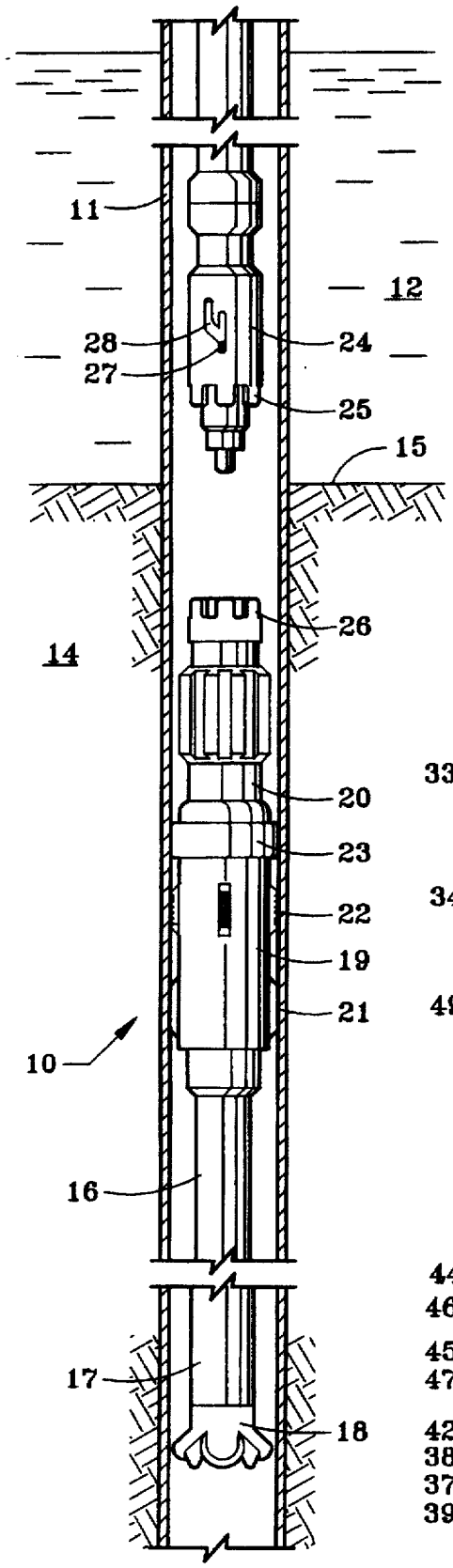
FIG. 1 is a vertical elevation, partially in section, illustrating the assembly of the present invention sealing a well drilled through a body of water and supporting a drillstring within the well at a point below the water bottom.

Referring to FIG. 1, the apparatus of the present invention is illustrated generally at 10 anchored within a well pipe 11. The pipe 11 extends from a surface well drilling platform (not illustrated) through a body of water 12 and into a well bore 13 formed through an earth formation 14 underlying the water. The assembly 10 is anchored at a location within the pipe 11 at a vertical location below a water bottom 15.

The surface drilling platform (not illustrated), which may be a floating drill ship or a conventional drilling platform may be several hundred feet or more above the bottom 14. Under normal conditions, that part of the pipe 11 extending through the water is subjected to strong horizontal and axial current and wave induced forces. These forces are increased tremendously in stormy weather. Pipe movement is especially severe where the drilling platform is a drillship or other floating rig. These forces and movement must be dealt with while engaging in surface controlled subsurface operations.

The assembly 10 is illustrated temporarily supporting well equipment represented by a drill string 16, drill collars 17 and a bit 18 within the well pipe or casing 11. The assembly 10 and suspended drilling equipment 16, 17 and 18 are below the water bottom 15 where they are protected from damage which may be inflicted on the segment of pipe 11 which extends above the water bottom 15. Typically, as a result of storm action, the pipe 11 is bent over at the water bottom 15 when the storm displaces or destroys the surface support structure. When this occurs, it is important that the anchoring assembly 10 remain firmly set and that the well conduit remain properly sealed. Retrieval of the anchored assembly 10 may be effected after the damaged surface extending pipe is replaced or repaired.

The assembly 10 of the present invention includes an anchoring and sealing bridge plug packer 19 and a valve section 20. The packer 19 is equipped with friction pressure blocks 21, anchoring slip segments 22 and an elastomeric seal element 23. The purpose of the packer 19 is to temporarily anchor the assembly 10 within the surrounding casing 11 and provide a seal with the casing.

The assembly 10 and the connected drill string are lowered into position from the drilling platform with an actuating tool 24. The actuating tool 24 is formed by a string of drill pipe or other suitable conduit and is employed to position, set and retrieve the assembly 19. The tool 24 also provides fluid communication between the well surface and the assembly 10 as may be required for pressure or flow control of the well or the equipment attached to the assembly 22.

When properly positioned within the pipe 11, the assembly 10 is actuated by the tool 24 to move from its unset position with the slips 22 and seal element 23 radially retracted to its set position which is illustrated in FIG. 1. This setting procedure is accomplished primarily by right-hand rotational movement of the actuation tool 24. Following setting of the assembly 10, the running tool is released as illustrated in FIG. 1 and retrieved to the surface.

In a preferred form of the assembly 10, the packer 19 may be a Baker Oil Tools Model "G" LOK-SET® retrievable bridge plug. This bridge plug is set by right-hand rotation of the actuation tool and, when set, seals against high differential pressure from either below or above the seal element 23. The described bridge plug is also capable of being unset by a direct axial pull accompanied with right hand torque on the actuating tool. As will hereinafter be more fully described, the function and operation of the bridge plug in cooperation with the valving control of the present invention provide a means for positive control and operation of the subsurface tools during extreme weather conditions.

A clutch of the present invention, indicated in pan by mating ends 25 and 26 of the actuating tool 24 and the assembly 10, respectively, permits the application of rotary torque through the tool to the packer 19 so long as the clutch remains engaged. As the actuating tool is rotated, the friction dogs 21 resist rotation causing the slip segments 22 to be extended radially outwardly into engagement with the internal walls of the casing 11. The slip engagement prevents axial displacement of the assembly 10 as axial force is repeatedly applied to and released from the running tool to increasingly wedge the slips outwardly and extrude the packer seal element 23 into sealing engagement with the well pipe 11.

The anchoring engagement of the assembly 10 may be released by pulling up while applying right hand torque to the actuating tool. So long as the ends 25 and 26 of the clutch mechanism remain fully engaged, the assembly 10 may be repeatedly set and unset by the described procedure.

Release of the assembly 10 from the actuating tool is accomplished with the use of the novel clutch design of the present invention. As will be more fully described, the actuating tool 24 is prepared for disengagement from the set assembly 10 by first applying an axial force on the tool 24 to place the tool in tension. While maintaining the actuating tool in tension, left-hand control torque is applied and held on the tool. While maintaining the left-hand control torque, the axial force on the tool is released until the tool is placed slightly in compression. A right-hand control torque is then applied to the tool and additional tool compression forces are applied. This sequence of tool control movements and force applications moves a cam pin 27 through a cam slot pattern 28 to disengage the mechanical linkage between the clutch ends 25 and 26 so that relative rotational movement between the ends 25 and 26 is permitted. Subsequent right hand rotation of the actuating tool 24 causes left-hand threads on the tool to disengage left-hand threads in the assembly 10 to permit full release from the set assembly.

Figure 2:
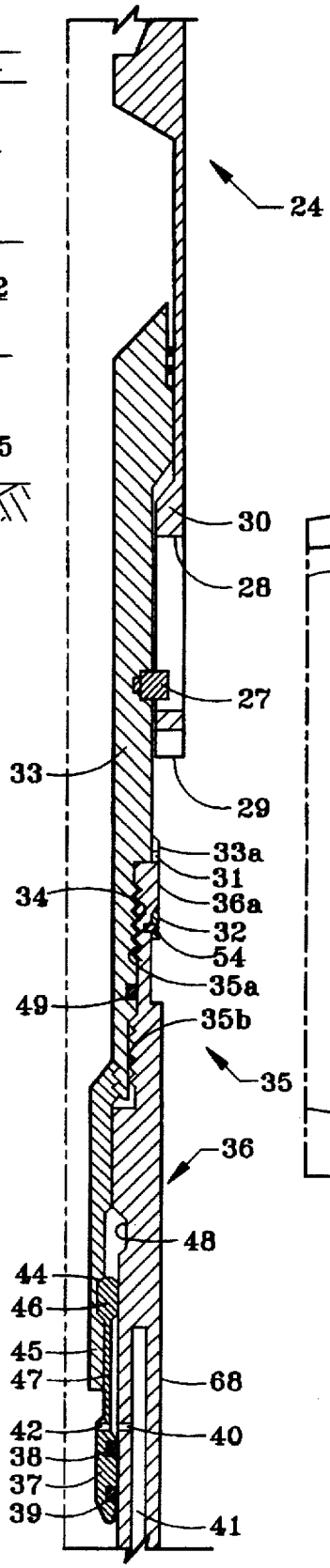
FIG. 2 is a schematic vertical sectional view of a portion of the assembly of the present invention illustrating engagement with an actuating tool prior to being set and disengaged within the well casing.

FIG. 2 illustrates general features in the assembly and operation of the actuation tool 24 and valve section 20 of the present invention. The assembly is illustrated after setting of the bridge plug 19 (not illustrated in FIG. 2) and before release of the clutch.

The clutch mechanism includes release fingers 29 formed at the base of a cam sleeve 30. Torque fingers 31 extend upwardly from a torque sleeve 32 and are designed to align with the spaces between splines 33*a* formed on a control mandrel 33. The mandrel 33 has left-hand threads 34 which connect with left-hand threads 35*a* on a double threaded valve section 35 of a tubular valve housing 36. Right-hand threads 35*b* are also formed in the section 35 for a purpose to be hereinafter described.

The torque fingers 31 extend between splines 36*a* formed at the upper end of the housing 36. With the fingers extending between aligned splines 33*a* and 36*a*, the components 33 and 36 are locked rotational relative to each other. With the clutch disengaged, right-hand rotation of the tool 24 causes the threads 34 and 35*a* to disengage which frees the actuation tool 24 from the valve section 20. Following clutch disengagement, the initial rotation of the tool 24 produces axial displacement between the tool and the valve housing 36 which draws a valve closure sleeve 37 from a valve open position illustrated in FIG. 2 to a valve closed position. Valve closure occurs when axially spaced o-ring seals 38 and 39 are moved up to form seals above and below radial flow ports 40 formed through the valve housing 36. In the open valve position illustrated in FIG. 2, fluid flow is permitted through an annular flow passages 41 in the valve section, through multiple radial housing ports 40 and through multiple radial valve sleeve ports 42. This flow path is controlled by movement of the sleeve 37 to permit pressure equalization across the set packer seal 23. As previously described, the open flow passage also permits flow and pressure equilibrium when the unset assembly is being moved into or out of the well.

Opening movement of the valve sleeve 37 occurs automatically as the actuation tool rotates the control mandrel 33. As will be more fully described hereinafter with reference to FIG. 6, a retention slot 44 in a stinger 45 carried at the bottom of the tool 24 traps collet heads 46 formed at the upper end of resilient collet fingers 47 which extend upwardly from the valve sleeve 37. The trapped collet heads 46 are dragged upwardly with the disengaging control mandrel 33 until they register with a release slot 48 formed on the internal walls of the well housing 36. When the collet heads register with the slot 48, they are permitted to open radially away from the retention slot 44 to release the upwardly moving control mandrel. In the released position, the valve sleeve 37 seals the valve section ports 40 to prevent flow through the valve bypass.

During the initial separation of the mandrel 33 and housing 36, an o-ring seal 49 prevents leakage through the threaded connection between the two components. The valve sleeve 37 completely seals the bypass openings 40 before the left-hand threads 34 and 35 are fully disengaged which serves to protect the o-ring seal 49 from being eroded or displaced by fluid flow through the separating connection.

Figure 3:
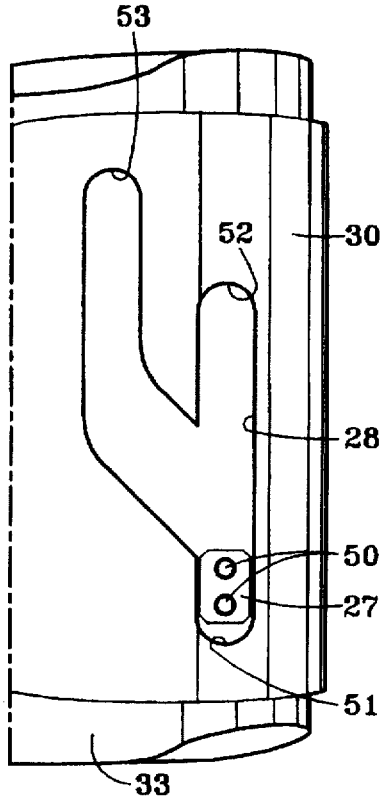
FIG. 3 is a schematic depiction of a cam pattern employed for selective disengagement of the clutch connecting the actuating tool and the anchoring and sealing assembly of the present invention.

FIG. 3 illustrates details in the configuration of the cam slot 28 formed in the cam sleeve 30. The sleeve 30 is shown surrounding the control mandrel 33 with the cam pin 27 mounted on the mandrel and projecting radially out into the slot 28. For assembly purposes, the pin 27 is removably secured to the mandrel 33 by bolts 50.

The pin 27 is in a lowermost cam slot section 51 with the clutch engaged. Right-hand rotation of the tool 24 and attached cam sleeve 30 is transmitted through the pin 27 and to the mandrel 33. Engagement of the torque fingers 31 with the splines 33*a* and 36*a* prevents relative rotation between the mandrel 33 and the well housing 36 so that the actuating tool movement is transmitted to the bridge plug as required to set or release the bridge plug.

The illustrated slot configuration keeps the relative circumferential position of the sleeve 30 and control mandrel 33 fixed so long as only right-hand torque is applied through the actuation tool. Similarly, axial displacement between the mandrel and sleeve is limited by pin movement between cam positions 51 and 52 so long as only right-hand torque is applied during axial movement of the tool 24. Movement of the pin between the slot positions 51 and 52 provides the range of control movements necessary to position and repeatedly set or release the liner hangar with right-hand rotation and axial tool movements.

Figure 4:
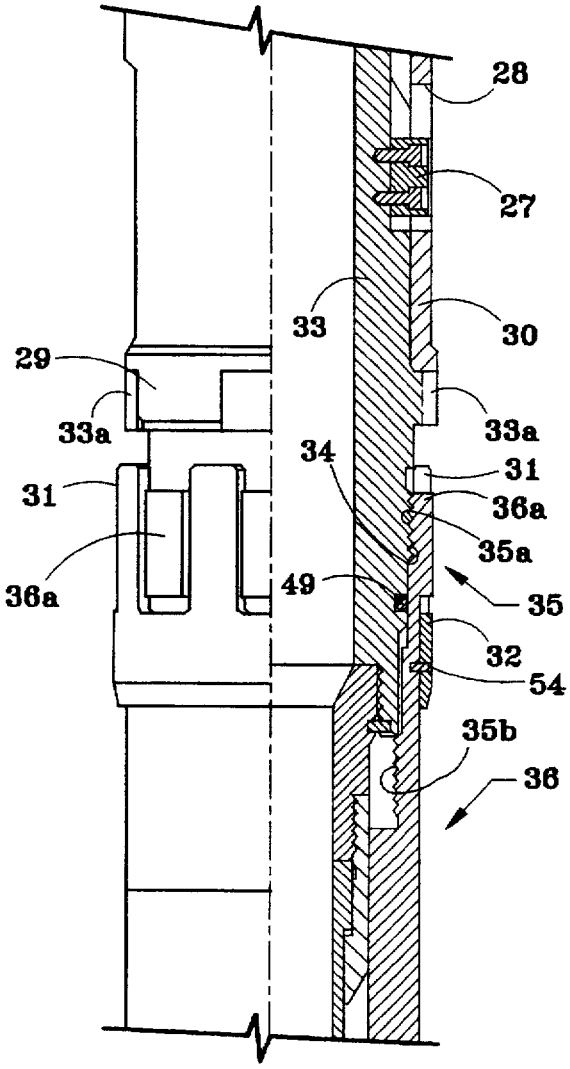
FIG. 4 is a partial elevation, partially in section, illustrating details in the mating connection between the anchoring and sealing assembly and the actuation tool of the present invention.

Referring jointly to FIGS. 2, 3 and 4, the clutch of the present invention is disengaged when it is desired to release the actuation tool from the set bridge plug and valve assembly. After the bridge plug is properly anchored, the actuation tool is pulled into tension which shifts the sleeve 30 upwardly causing the slot position 51 to be moved to the pin 27. With the tool 54 in tension, left-hand torque is placed and held on the tool while the tool tension is released which moves the sleeve down and to the left so that a top cam position 53 is moved to the key 27. The application of slight right-hand torque at this point aligns the base of the release fingers 29 over the top of the torque fingers 31. The right-hand torque is released and additional actuation tool weight is allowed to be applied to the sleeve 30 which pushes the release fingers down against the top of the torque fingers 31 causing a shear pin 54 holding the sleeve 32 to the valve assembly 36 to sever. This forces the sleeve 32 and attached fingers 31 down and out of engagement with the splines 33*a*, so that the mandrel 33 and valve housing 36 are free to rotate relative to each other. Subsequent right-hand rotation of the tool 24 causes the threads 34 and 35*a* to disengage to permit retrieval of the tool 24 to the surface.

Figure 5:
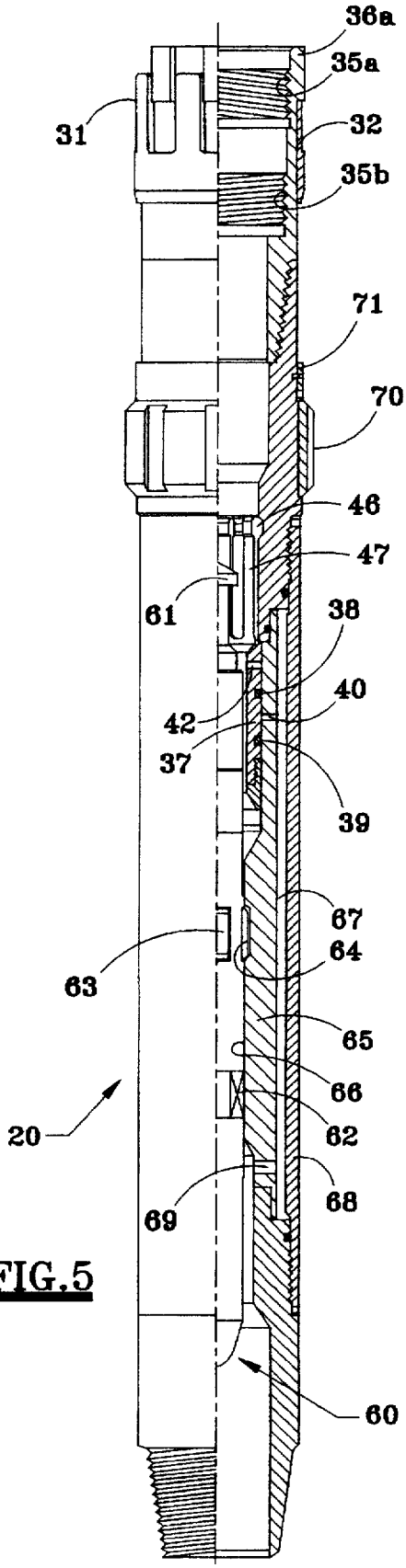
FIG. 5 is an elevation, partially in section, illustrating valve details in the assembly of the present invention in its anchored and sealing position within the well.

FIG. 5 illustrates details in the valve assembly section 20 of the present invention as it appears anchored in a well above an anchored bridge plug assembly. The section 35 is provided in the form of a sub assembly which is equipped with the left-hand threads 35*a* and the right-hand threads 35*b*. The valve body is illustrated with the bypass flow passage in closed position and a blanking plug 60 landed within the section 20 to completely seal the well from pressure above and below. The plug 60 includes a fishing neck 61, a seal 62 and locking dogs 63. The dogs 63 engage and lock in recesses 64 formed within a plug sleeve 65. The plug 60, which may preferably be a Baker Model "FWG" blanking plug, may be run or retrieved on wireline or other tool running equipment. When landed in the valve section 20 of the present invention, the plug 60 provides a fluid and pressure tight seal within the valve's central opening. The plug 60, when in the illustrated position, cooperates with the bypass sleeve seal 57 and the packer seal 23 to completely seal the well conduit 11 as illustrated in FIG. 1.

When the plug 60 is being retrieved, a wireline tool engages the fishing neck 61 and pulls it up to open a bypass (not illustrated) within the plug which permits pressure equalization across the set assembly, the wireline retrieving force also releases the dogs 63 from the recess 64 to permit retrieval of the plug. Removal of the plug 60 permits free access through the valve 20 to the tools or well structure below the valve.

One of the features of the present invention is the provision of a removable plug receiving sleeve 65. The sleeve may be quickly and easily replaced in the event either the internal sleeve seal surface 66 or the locking recess 62 are damaged by the placement or retrieval of the plug 60 or by working through the sleeve 65.

The sleeve 65 also provides a secondary function as the internal member of a tubular flow passage 67 formed between the sleeve 65 and outer wall 68 of the valve housing 36. The flow passage 67 corresponds in junction with the flow path 41 illustrated schematically in FIG. 2. The flow passage 67 cooperates with the multiple ports 42 in the valve sleeve 37 and the multiple radial openings 69 and 40 formed through the sleeve 65 to provide a large volume flow path for bypass flow through the valve.

Another feature of the invention is the provision of a removable centralizer 70 which may be changed as desired for use of the assembly 10 in well pipes of differing internal diameter. The centralizer 70, which serves to retain the assembly 10 substantially centered within the surrounding well pipe is held in place by a removable keeper ring 71. When the assembly 10 is used in a larger or smaller pipe, the ring 71 may be removed and the centralizer 70 slipped off and replaced by an appropriately sized centralizer.

Figure 6:
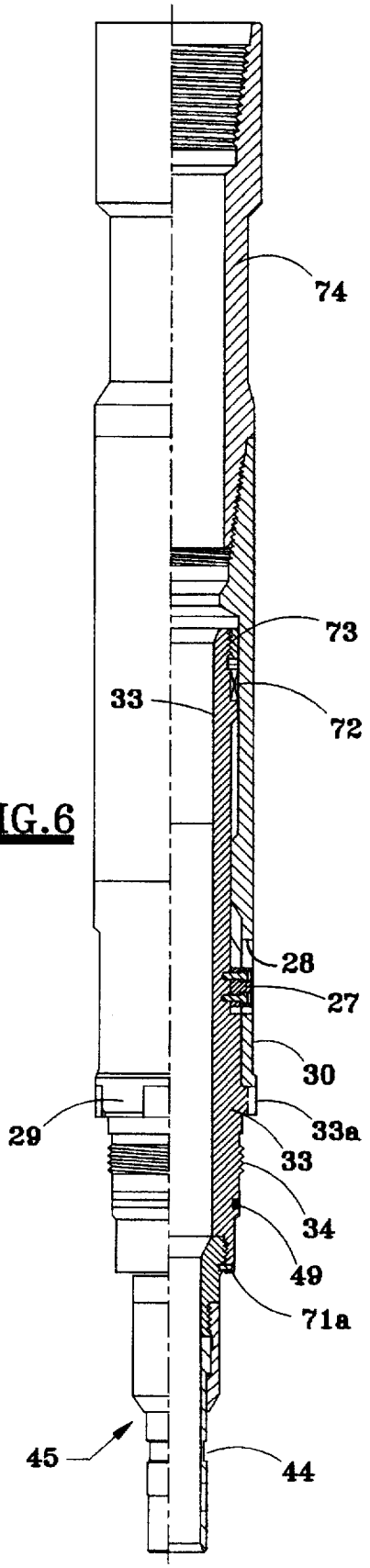
FIG. 6 is a vertical elevation, partially in section, illustrating the actuating tool of the present invention after having set and released from the anchoring and sealing assembly.

FIG. 6 illustrates the actuating tool 24 as it appears following separation from the anchored valve assembly 20. The tool 24 includes the stinger assembly indicated generally at 45 which is threadedly engaged to the base of the control mandrel 33. A set screw 71*a* retains the stinger in its threaded connection with the control mandrel. The stinger 45 includes the retention slot 44 which is used to trap the collet heads of the valve sleeve 37.

A packing seal 72 held in place with a keeper ting 73 at the upper end of the control mandrel 33 provides a sliding and sealing engagement with the internal walls of the cam sleeve 30. It will be understood that the seal 72 retains sealing engagement between the relatively moveable mandrel 33 and cam housing 30 during the manipulation of the cam slot 28 over the cam pin 27. The upper end of the cam sleeve 30 is connected to a crossover sub-assembly 74 which in turn is connected to the tubing or drill pipe running string (not illustrated).

Figure 7:
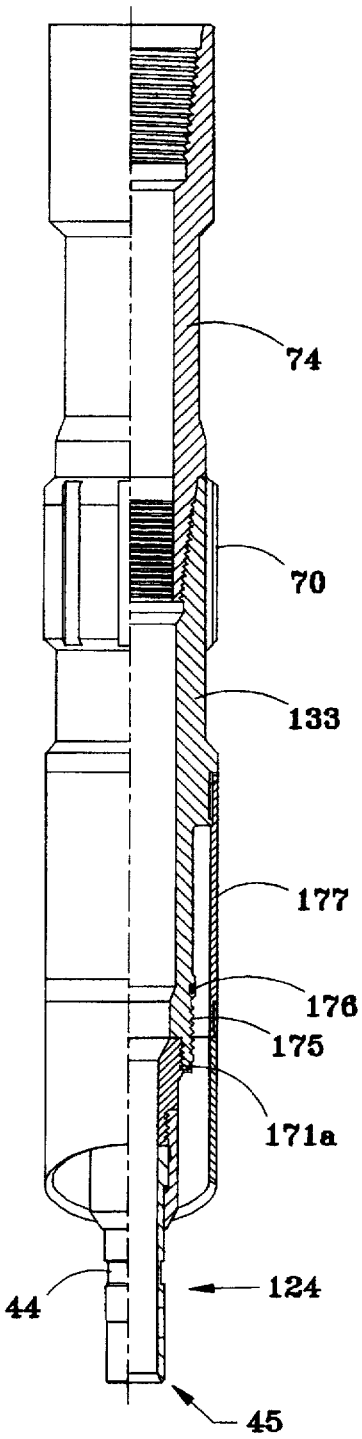
FIG. 7 is a vertical elevation, partially in section, illustrating the actuating tool of the present invention configured to reengage, unset and retrieve the anchoring and sealing assembly.

FIG. 7 illustrates the actuating tool indicated generally at 124 as it is configured to retrieve the set valve assembly 20. The tool 124 includes the stinger assembly 45 threadedly attached to a tubular retrieving mandrel 133. The stinger is locked in place with a set screw 171*a*.

Right-hand threads 175 are formed at the base of the retrieving mandrel 133 and an o-ring seal 176 is carried on the mandrel above the threads. A washover sleeve 177 is secured to the mandrel 133 to protect the threads 175 and seal 176 during the trip down-hole to retrieve the valve 20. The adaptor sub-assembly 74 is threadedly engaged to the top of the mandrel 133 for connecting the tool to the running string.

In operation, with joint reference to FIGS. 5 and 7, the tool 124 is lowered into the well to the anchored valve assembly 20. The stinger 45 enters the top of the valve assembly 20 and is moved down until the end of the stinger engages the internal diameter of the seal sleeve 37. At this point, the collet heads 46 are in registry with the retention slot 44 of the stinger. Engagement of the right-hand threads 175 of the actuating tool with the right-hand threads 35*b* of the sub-assembly 35 prevents further downward movement of the tool. Right-hand rotation of the tool 124 causes the threads 175 and 35*b* to engage and advance the setting tool and stinger 45 down through the valve assembly 10. This movement of the stinger pushes the sliding valve sleeve 37 down to open the bypass port 40. When the threads 175 and 35*b* are fully engaged, the set bridge plug may be released by right-hand rotation and axial pull of the actuating tool 124 to permit retrieval of the valve, bridge plug and attached equipment to the well surface.

The foregoing disclosure and description of the invention is illustrative and explanatory thereof, and it will be appreciated by those skilled in the art that various changes in the size, shape and materials as well as in the details of the illustrated construction or combinations of features of the various system elements and the method discussed herein may be made without departing from the spirit of the invention.

What is claimed is:

1. An apparatus for retrievably anchoring equipment at a subsurface location within a well pipe, comprising:

a packer for releasably anchoring and sealing against the internal surface of said well pipe;

a flow passage extending through said packer for communicating fluid pressure axially across said packer assembly;

a valve assembly for selectively opening and closing said flow passage to control fluid communication from the interior of said well pipe axially above said packer to the interior of said well pipe axially below said packer, said valve assembly being opened by right-hand rotation of said actuating tool; and a rotatable actuating tool for actuating said valve assembly by rotary motion applied through said actuating tool to said packer.

2. The apparatus as defined in claim 1 wherein said valve assembly is closed by right-hand rotation of said actuating tool.

3. The apparatus as defined in claim 1 further comprising:

a release mechanism for releasing said actuating tool from said packer after said packer has been anchored and sealed within said well pipe.

4. The apparatus as defined in claim 3 wherein said release mechanism includes left-hand threads which separate upon right-hand rotation of said actuating tool.

5. The apparatus as defined in claim 3 further comprising:

a retrieving mechanism for reengaging and securing said actuating tool with said packer after said actuating tool has been released from said packer; and a packer release mechanism operable by said actuating tool to release said packer from its anchored and sealing engagement with said well pipe.

6. The apparatus as defined in claim 5 wherein said retrieving mechanism includes right-hand threads which engage upon right-hand rotation of said actuating tool.

7. The apparatus as defined in claim 4 wherein said valve assembly is opened by right-hand rotation of said actuating tool and said valve assembly is closed by right-hand rotation of said actuating tool.

8. The apparatus as defined in claim 3 wherein said release mechanism comprises:

a clutch which when engaged transmits rotation of said actuating tool to said packer to set said packer and which when disengaged transmits rotation of said actuating tool to said release mechanism to release said actuating tool from said packer.

9. The apparatus as defined in claim 8 wherein said clutch comprises:

torque fingers for interlocking with splines on said actuating tool and said packer; and displacement fingers operable by movement of said actuation tool to displace said torque fingers from interlocking engagement with said splines to permit relative rotational movement between said actuating tool and said packer.

10. The apparatus as defined in claim 1 further comprising:

a seal in said valve assembly; and a seal coveting for protecting said seal when said flow passage is open.

11. The apparatus as defined in claim 1 further comprising:

a central flow opening extending axially through said packer for fluid flow through said packer and for mechanical access to said well pipe axially below said packer; and a plug receiving sleeve defining a portion of said central flow opening for receiving a retrievable plug to close and seal said central flow opening.

12. The apparatus as defined in claim 11 wherein said sleeve is removably connected in said packer.

13. An apparatus as defined in claim 3 further comprising:

a valve shifting mechanism for automatically closing said flow passage when said actuating tool is released from said packer.

14. The apparatus as defined in claim 5 further comprising:

a valve shifting mechanism for automatically opening said flow passage when said retrieving mechanism reengages said packer.

15. The apparatus as defined in claim 1 further comprising:

packer setting mechanism operable by right-hand rotation of said actuating tool for anchoring said packer within said well pipe.

16. The apparatus as defined in claim 1 further comprising:

packer release mechanism operable by right-hand rotation of said actuating tool for releasing said packer from anchoring engagement with said well pipe.

17. The apparatus as defined in claim 3 further comprising:

a packer setting mechanism operable by right-hand rotation of said actuating tool for anchoring said packer within said well pipe.

18. A retrievable assembly for subsurface placement of equipment within a well, comprising:

an axially extending anchoring and sealing packer for selective anchoring and sealing engagement with the internal tubular wall of a well pipe;

a bypass flow passage extending axially through said packer for providing fluid and pressure communication axially across said packer;

a valve member functionally connected with said bypass passage, said valve member being moveable with respect to said packer between positions opening or closing said passage to said fluid and pressure communication;

an actuation tool operable from the well surface and connectable with said packer for anchoring and sealing said packer at a subsurface location within said well pipe, said valve member being moved to open and closed positions by right-hand rotation of said actuating tool;

a releasable connector operable with said actuation tool and said packer for releasing said actuation tool from said packer after said packer has been anchored in said well pipe; and a valve closure control member for moving said valve member from open to closed positions as said actuation tool is released from said packer.

19. The assembly as defined in claim 18 further comprising:

a retrieval connector for reengaging and releasing said packer from its anchored placement in said well pipe; and a valve opening control connector for moving said valve member from closed to open positions as said tool reengages said packer.

20. The assembly as defined in claim 18 wherein said packer is anchored and sealed by right-hand rotation of said actuation tool.

21. The assembly as defined in claim 20 wherein said actuation tool is released from said packer by right-hand rotation of said actuation tool.

22. The assembly as defined in claim 19 wherein said packer is anchored and sealed by right-hand rotation of said actuation tool, and said actuation tool is released from said packer by right-hand rotation of said actuation tool.

23. The assembly as defined in claim 18 further comprising:

a seal between said valve member and said packer; and a seal covering for protecting said seat when said bypass passage is open and when said valve member is moved from said positions opening or closing said bypass passage.

24. The apparatus as defined in claim 18 further comprising:

a central flow opening extending axially through said packer for fluid flow through said packer and for mechanical access to the area in said well pipe axially below said packer; and a plug receiving sleeve defining a portion of said central flow opening for receiving a retrievable plug to close and seal said central opening.

25. The apparatus as defined in claim 24 wherein said sleeve is removably connected in said packer.

26. A method of temporarily anchoring an assembly at a subsurface location within a well pipe, comprising:

lowering the assembly through the well to the subsurface location with an actuating tool;

rotating the actuating tool to the right to convey rotary motion through a clutch and set the assembly at the subsurface location;

opening a flow bypass in said assembly with the right-hand rotation of the actuating tool;

manipulating the actuating tool to disengage the clutch;

rotating the actuating tool to the right to disengage the set assembly from the actuating tool;

reengaging said set assembly with said actuating tool;

rotating said actuating tool to the right to engage right-hand threads in said assembly and said actuating tool; and rotating said actuating tool to the right to unset said assembly.

27. The method as defined in claim 26 further comprising:

closing a bypass flow passage in said assembly with the right-hand rotation of the actuating tool used to disengage the set assembly.

28. The method as defined in claim 27 further comprising:

reengaging said set assembly with said actuating tool;

rotating said actuating tool to the right to engage right-hand threads in said assembly and said tool; and rotating said actuating tool to the right to unset said assembly.

29. A retrievable assembly for subsurface placement of equipment within a well, comprising:

an axially extending anchoring and sealing packer for selective anchoring and sealing engagement with the internal tubular wall of a well pipe;

a bypass flow passage extending axially through said packer for providing fluid and pressure communication axially across said packer;

a valve member functionally connected with said bypass passage, said valve member being moveable with respect to said packer between positions opening or closing said passage to said fluid and pressure communication;

an actuation tool operable from the well surface and connectable with said packer for anchoring and sealing said packer at a subsurface location within said well pipe;

a releasable connector operable with said actuation tool and said packer for releasing said actuation tool from said packer after said packer has been anchored in said well pipe;

a valve closure control member for moving said valve member from open to closed positions as said actuation tool is released from said packer;

a retrieval connector for reengaging and releasing said packer from its anchored placement in said well pipe; and a valve opening control connector for moving said valve member from closed to open positions as said tool rengages said packer.

30. The apparatus as defined in claim 29, wherein said packer is anchored and sealed by right-hand rotation of said actuation tool.

31. The apparatus as defined in claim 29, wherein said actuation tool is released from said packer by right-hand rotation of said actuation tool.

32. The apparatus as defined in claim 29, wherein said packer is anchored and sealed by right-hand rotation of said actuation tool, and said actuation tool is released from said packer by right-hand rotation of said actuation tool.

* * * * *

UNITED STATES PATENT AND TRADEMARK OFFICE

CERTIFICATE OF CORRECTION

PATENT NO. : 5,697,449

DATED : Dec. 16, 1997

INVENTOR(S) : Gregory E. Hennig; David Martin; and Mark McCorry

It is certified that error appears in the above-indentified patent and that said Letters Patent is hereby corrected as shown below:

In Col. 11, line 9, change "coveting" to --covering--.

Signed and Sealed this

Twenty-fourth Day of February, 1998

*Attest:*

Bruce Lehman

BRUCE LEHMAN

*Attesting Officer*

*Commissioner of Patents and Trademarks*